US010590810B2

(12) United States Patent
Ferreira et al.

(10) Patent No.: US 10,590,810 B2
(45) Date of Patent: Mar. 17, 2020

(54) LASH ADJUSTMENT IN LOST MOTION ENGINE SYSTEMS

(71) Applicant: Jacobs Vehicle Systems, Inc., Bloomfield, CT (US)

(72) Inventors: David M. Ferreira, Glastonbury, CT (US); Gabriel S. Roberts, Wallingford, CT (US); Justin D. Baltrucki, Canton, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 16/186,500

(22) Filed: Nov. 10, 2018

(65) Prior Publication Data

US 2019/0145289 A1 May 16, 2019

Related U.S. Application Data

(60) Provisional application No. 62/584,642, filed on Nov. 10, 2017.

(51) Int. Cl.
*F01L 1/14* (2006.01)
*F01L 1/255* (2006.01)
(Continued)

(52) U.S. Cl.
CPC ..... *F01L 1/255* (2013.01); *F01L 1/08* (2013.01); *F01L 1/181* (2013.01); *F01L 1/24* (2013.01);
(Continued)

(58) Field of Classification Search
CPC ... F01L 1/255; F01L 1/08; F01L 1/181; F01L 1/24; F01L 1/2416; F01L 1/26;
(Continued)

(56) References Cited

U.S. PATENT DOCUMENTS 9,611,767 B2 4/2017 Baltrucki
2008/0190391 A1* 8/2008 McElwee ..... F01L 1/146 123/90.55
(Continued)

FOREIGN PATENT DOCUMENTS

WO 2016174493 A1 11/2016

OTHER PUBLICATIONS

Written Opinion of the ISA for International Appl. No. PCT/US2018/060225 dated Mar. 11, 2019, 7 pages.
International Search Report for International Appl. No. PCT/US2018/060225 dated Mar. 11, 2019, 3 pages.

*Primary Examiner* — Zelalem Eshete
(74) *Attorney, Agent, or Firm* — Moreno IP Law LLC

(57) ABSTRACT

Systems for valve actuation in internal combustion engines provide configurations for hydraulic lash adjusters and valve actuation valvetrain components that are particularly suitable for prevention of HLA jacking in lost motion cam environments and in valve bridge environments. In one implementation, a rocker arm may transmit motion from a lost motion cam having main event and auxiliary event lobes. Main event motion is transmitted to two engine valves through the rocker arm, a lash adjuster, lash adjuster loading component and valve bridge, which define part of a first load path. Braking motion is transmitted to one of the engine valves through an inboard valve actuator and bridge pin, which define part of a second load path. The HLA is thus disposed in a separate load path from the braking valve load and the lash adjuster loading component keeps the lash adjuster under a constant compressive force to prevent jacking.

20 Claims, 6 Drawing Sheets

(51) Int. Cl.

| | |
|---|---|
| ***F01L 1/24*** | (2006.01) |
| ***F01L 1/18*** | (2006.01) |
| ***F01L 1/26*** | (2006.01) |
| ***F01L 13/06*** | (2006.01) |
| ***F01L 1/08*** | (2006.01) |
| *F01L 13/00* | (2006.01) |

(52) U.S. Cl.
CPC ..... *F01L 1/2416* (2013.01); *F01L 1/26* (2013.01); *F01L 13/065* (2013.01); *F01L 2001/2433* (2013.01); *F01L 2013/105* (2013.01); *F01L 2105/00* (2013.01)

(58) Field of Classification Search
CPC ..... F01L 13/065; F01L 2001/2433; F01L 2013/105; F01L 2105/00
See application file for complete search history.

(56) References Cited

U.S. PATENT DOCUMENTS

| | | | | |
|---|---|---|---|---|
| 2011/0079196 | A1 | 4/2011 | Kraft et al. | |
| 2012/0298057 | A1* | 11/2012 | Janak ..... | F01L 1/08 123/90.12 |
| 2014/0083381 | A1* | 3/2014 | Roberts ..... | F01L 1/08 123/90.15 |
| 2015/0122220 | A1* | 5/2015 | Cecur ..... | F01L 1/24 123/321 |
| 2016/0084122 | A1 | 3/2016 | Baltrucki | |
| 2017/0175597 | A1 | 6/2017 | Cecur | |
| 2017/0321576 | A1 | 11/2017 | Nielsen | |

* cited by examiner

LASH ADJUSTMENT IN LOST MOTION ENGINE SYSTEMS

FIELD

This disclosure relates generally to systems for actuating valves in internal combustion engines. More particularly, this disclosure relates to engine valve actuation systems that utilize lost motion components and features for lash adjustment.

BACKGROUND

Internal combustion engines require valve actuation systems to control the flow of combustible components, typically fuel and air, to one or more combustion chambers during operation. Such systems control the motion and timing of intake and exhaust valves during engine operation. In a positive power mode, intake valves are opened to admit fuel and air into a cylinder for combustion and exhaust valves are subsequently opened to allow combustion products to escape the cylinder. This operation is typically called a "positive power" operation of the engine and the motions applied to the valves during positive power operation are typically called "main event" valve actuation motions. Auxiliary valve actuation motion, such as motion that results in engine braking (power absorbing), may be accomplished using "auxiliary" events imparted to one or more of the engine valves.

Valve movement during main event positive power modes of operation is typically controlled by one or more rotating cams as motion sources. Cam followers, push rods, rocker arms and other elements disposed in a valvetrain provide for direct transfer of motion from the cam surface to the valves. The use of a valve bridge may impart motion to plural valves from a single upstream valvetrain. For auxiliary events, "lost motion" devices may be utilized in the valvetrain to facilitate auxiliary event valve movement. Lost motion devices refer to a class of technical solutions in which valve motion is modified compared to the motion that would otherwise occur as a result of actuation by a respective cam surface alone. Lost motion devices may include devices whose length, rigidity or compressibility is varied and controlled in order to facilitate the selective occurrence of auxiliary events in addition to, or as an alternative to, main event operation of valves.

Lash adjustment features are typically provided on valve actuation systems to facilitate the elimination of lash, which is excessive clearance between valvetrain components that can lead to excessive noise, vibration, impact forces and wear. For example, during braking events, substantial lash may be introduced into the engine valvetrain. Lash adjusters, which are typically hydraulic lash adjusters ("HLA's"), may include mechanical components that cooperate to expand under hydraulic pressure in a lash take-up mode during one portion of the valve cycle, typically when the valvetrain is under low load or unloaded, and then assume a hydraulically "locked" or incompressible mode during another portion of the valve cycle, typically when the valvetrain is under high load, for example, during a main event actuation. One challenge related to the use of HLA's is the prevention of over-extension or "jacking" of the HLA, which may occur when the HLA is permitted to extend too far in the take-up mode and becomes hydraulically locked in the over-extended position. This can result in excessive valvetrain forces and other undesirable consequences. As such measures have been taken in the prior art to prevent jacking by maintaining suitable loads on the HLA or to limit HLA extension.

Prior art valve actuation systems with lash adjustment include systems such as those described in U.S. Pat. No. 9,611,767, and US patent Published Application No. 2015/0354418. The subject matter of both of these documents is incorporated herein by reference in its entirety. Such systems provide lash adjustment features that may be integrated into valvetrain components in a fulcrum valve bridge arrangement. In such systems, the lost motion components are typically situated in the same load path as the HLA. These systems have been developed and are particularly suited for valve actuation systems that utilize a dedicated cam for auxiliary motion. However, their application to other types of valve actuation systems, such as systems which utilize lost motion cams rather than dedicated auxiliary cams, may introduce complexities with regard to the prevention of HLA jacking.

In contrast to dedicated cam auxiliary motion systems, which utilize a dedicated cam for imparting auxiliary motion, lost motion cam systems typically use at least one cam with different profiled lift sections on the same cam lobe to impart motion for respective main event and one or more auxiliary events. These different profiled lift sections are activated or deactivated using a separate lost motion mechanism, such as a piston or actuator, located in the valvetrain. Example auxiliary events include engine braking, early exhaust valve opening (EEVO), or late intake valve closing (LIVC) lift events, and can be imparted to one or more valves in a valve set (i.e., two exhaust valves for a respective cylinder). Lost motion auxiliary valve lift systems, such as lost motion braking systems may employ a single rocker associated with the lost motion cam and a valve bridge associated with the rocker for actuating two engine valves in main event motion. Auxiliary valve lift or braking motion on one of the valves is facilitated by an auxiliary valve lift or braking actuator, which is a lost motion device that may be housed in the rocker and may selectively impart auxiliary or braking motion to the valve by way of a bridge pin disposed in the bridge and providing for independent motion relative thereto. The auxiliary valve lift or braking actuator is selectively activated and deactivated such that the auxiliary or braking event lift profile section or lobe on the lost motion cam only results in auxiliary or braking motion on the valve when an auxiliary event, such as engine braking is desired.

Adaptation of prior art systems, such as those described above, to lost motion cam environments, must factor in a number of considerations if they are to optimally support operation. For example, in systems that utilize a lost motion cam and a single rocker, often with an inboard valve actuator, for both main event and auxiliary (braking) valve motion, the interplay (i.e., fulcrum ratio and rocker ratio) between the rocker and fulcrum bridge may be different for main and auxiliary events. In addition, the primary (main event) motion is a higher lift event than the secondary (auxiliary or braking) motion lift events. Given these circumstances, the use of an HLA and a lost motion assembly on the same load path as in prior art systems may introduce complexities with regard to the interplay of those components. More particularly, the higher lift event may result an extension of the HLA beyond a tolerable limit suitable for a subsequent secondary motion, leaving the HLA in jacked or pumped out condition that increases risk of improper valve motion during the auxiliary event. Conversely, during auxiliary motion events operating on a single valve, the HLA may extend to take up a gap in the main event load path. This extension may result in improper valve motion during a subsequent main event motion. Prior art systems have provided limiters on the HLA piston stroke to ensure that the piston will not overextend. However, this requires lash to be set on the auxiliary valve motion system to ensure that the appropriate lift is achieved.

It would therefore be advantageous to provide systems that address the aforementioned shortcoming and others in the prior art.

SUMMARY

Responsive to the foregoing challenges, the instant disclosure provides various embodiments of valve actuation systems with lash adjustment and lost motion features for lost motion braking systems. More particularly, the disclosure provides systems where the HLA is provided with a lash adjuster loading assembly and both are disposed in a separate load path from the lost motion assembly. In this manner, the actuating load on the braking valve is isolated from the lash adjuster loading assembly. Thus, the biasing force on the HLA, and thus the risk of HLA jacking, may be controlled by the loading assembly without influence of the lost motion assembly. The system therefore provides facilitates HLA operation and reduced risk of HLA jacking in lost motion cam engine braking systems.

According to one aspect, a system for actuating at least one of two or more engine valves in an internal combustion engine may comprise a valve bridge operatively associated with the two or more engine valves, a rocker arm for transmitting motion from a motion source to the valve bridge through a first load path; a lost motion valve actuator for transmitting motion from the motion source to one of the two or more engine valves through a second load path; a lash adjuster disposed in the first load path; and a lash adjuster loading assembly disposed in the first load path for applying a load to the lash adjuster. The lash adjustor and lash adjuster loading assembly are disposed in a load path that is separate from the valve actuator and direct load of the braking valve.

According to another aspect, a system for actuating at least one of two or more engine valves in an internal combustion engine includes a lash adjuster loading assembly that maintains appropriate compressive force on the lash adjuster and is separate from the direct load of the braking valve. The lash adjuster loading assembly may be a stroke-limited component, such as a stroke-limited piston, that is spring biased in a direction that is opposite the lash adjuster extension direction. The lash adjuster loading assembly applies sufficient compressive force to prevent jacking of the lash adjuster during main event and auxiliary event operation.

According to another aspect, the lash adjuster and lash adjuster loading assembly may be housed in the valve bridge. The rocker arm may include an adjusting screw extending therefrom with a ball or swivel-mounted "elephant foot" or "e-foot" which engages a base of the bridge-mounted HLA. Fluid passages in the adjusting screw and e-foot provide hydraulic fluid to the HLA. The lash adjuster loading assembly may include a stroke limited component, such as a piston, housed within a bore in the valve bridge. The piston may include an internal bore for housing the lash adjuster. The piston biases the lash adjuster against the e-foot and and maintains a compressive force on the lash adjuster during main event and auxiliary event operation.

According to another aspect, the lash adjuster loading assembly may be provided with lost motion features such that auxiliary event motion is absorbed by the lash adjuster loading assembly and not conveyed to the valve bridge or engine valves.

Other aspects and advantages of the disclosure will be apparent to those of ordinary skill from the detailed description that follows and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto.

DETAILED DESCRIPTION

The functionality of components in an example valve actuation system according to aspects of the disclosure will first be explained generally, followed by a description of a more detailed example implementation. These general and example descriptions are intended to be illustrative and not exhaustive or limiting with regard to the inventions reflected in this disclosure.

Figure 1:
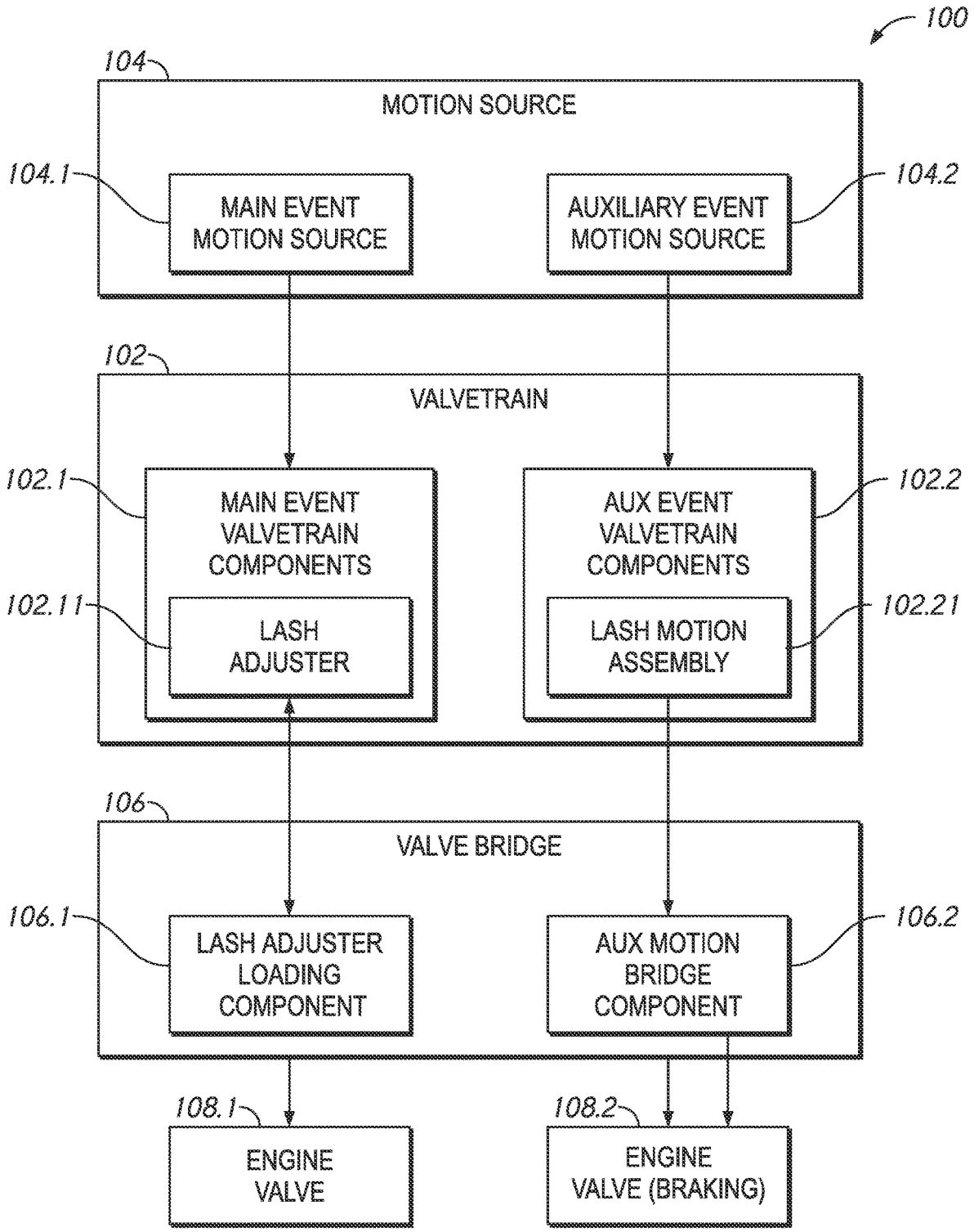
FIG. 1 is a schematic block diagram of a valve actuation system in accordance with aspects of the instant disclosure.

FIG. 1 is a schematic block diagram of a valve actuation system 100 according to aspects of the disclosure. A valve actuation motion source 104 may include main event motion source components 104.1 and auxiliary event motion source components 104.2. For example, the valve actuation motion source 104 may comprise a cam and camshaft driving components. The main event motion source components 104.1 may comprise a main event cam lobe on the cam and the auxiliary event motion source components 104.2 may comprise one or more auxiliary or lost motion cam lobes on the cam.

Motion from the motion sources 104.1 and 104.2 is transferred to valvetrain 102, which may comprise main event motion valvetrain components 102.1 and auxiliary event motion valvetrain components 102.2. It will be recognized that the valvetrain motion components 102.1 and 102.2 may comprise common elements. For example, the main event motion valvetrain components 102.1 and the auxiliary event motion valvetrain components 102.2 may utilize a common cam follower and a common rocker arm. Main event valvetrain components 102.1 may include a lash adjuster 102.11, which may be a hydraulic lash adjuster.

A lash adjuster 102.11 may be disposed in one of the main event motion valvetrain components 102.1, in which case that component can function as a housing for the lash adjuster. A lost motion assembly 102.21 may be included in the auxiliary event motion valvetrain components 102.2, in which case the component can function as a housing for the lost motion assembly.

The valvetrain 102 and components thereof cooperates with the valve bridge 106, which may impart motion to engine valves 108.1 and 108.2. According to an aspect of the disclosure, a lash adjuster loading component 106.1 may be housed in the valve bridge 106 and may cooperate with the lash adjuster 102.11 to keep the lash adjuster in a loaded state (i.e., with a force against the extended direction of the lash adjuster). Valve bridge 106 may also house an auxiliary motion bridge component 106.2, which may be a component that permits transfer of motion from the lost motion assembly 102.21 to a braking engine valve 108.2 without imparting motion to the valve bridge 106.

Figure 2:
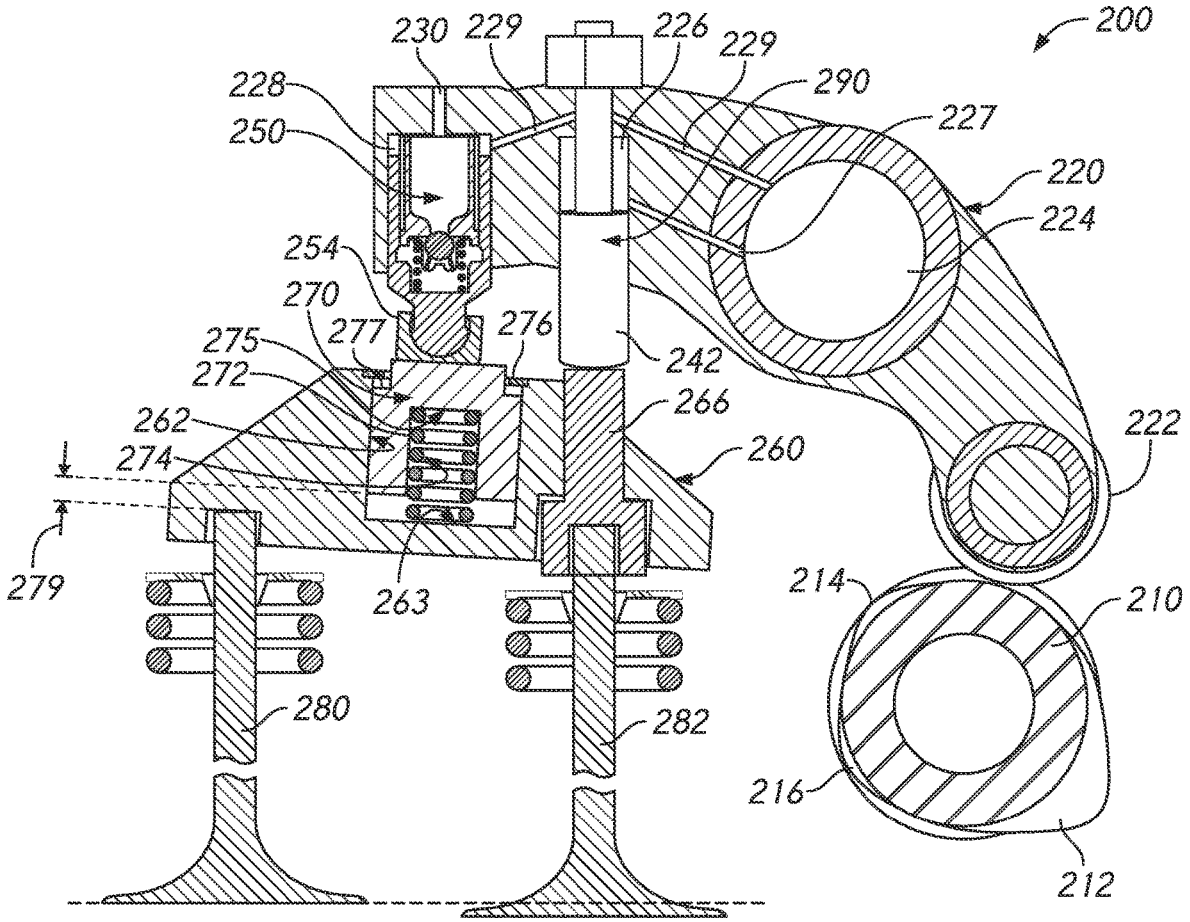
FIG. 2 is a schematic example implementation of a valve actuation system in accordance with the instant disclosure and the system of FIG. 1.
Figure 3:
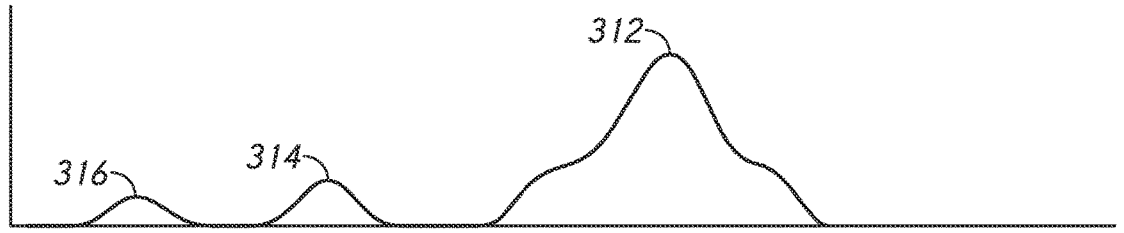
FIG. 3 is graphic representation of a lost motion cam profile.

FIG. 2 is a schematic illustration of a valve actuation system 200 in an implementation which is consistent with the functional block diagram of FIG. 1. A valve actuation motion source may be a lost motion cam 210 including a main event lobe 212 and auxiliary event lobes 214 and 216. Auxiliary events may include, but are not limited to, braking events, such as compression release (CR) braking, EEVO, LIVC or exhaust gas recirculation (EGR). Referring additionally to FIG. 3, further details of a lost motion cam are illustrated. An example profile of a lost motion cam may include a main event lobe profile 312, and auxiliary event lobe profiles 314 and 316. Corresponding motions are transmitted to the rocker arm 220 during each full rotation of the lost motion cam 210. Such motions may be selectively further transmitted to other valvetrain components, as will be further explained, to effect desired motion on the engine valves during main event and auxiliary events.

A rocker arm 220 includes a cam follower 222 and is mounted for pivoting or rotational movement about a rocker arm shaft (not shown) extending through rocker arm journal 224. Rocker arm 220 may include a first bore 226 for housing an inboard valve actuator 240 and a second bore 228 for housing an HLA 250. As those of ordinary skill in the art will recognize, rocker arm 220 will typically include a fluid passage 229 (represented schematically) therein for providing a constant supply of pressurized hydraulic fluid from the rocker arm journal 224 interior surface to the second bore 228 and the HLA. A vent 230 may provide for outflow of the hydraulic fluid from the piston bore 228. The hydraulic fluid is typically supplied via the rocker arm shaft (not shown). As is known in the art, the HLA may passively assume a lash adjustment mode, in which it fills with pressurized hydraulic fluid through ported passages in the rocker arm such that the HLA expands to take up lash in the valvetrain, and a hydraulically "locked" mode in which it is hydraulically isolated the hydraulic fluid within it is checked against outflow and therefore incompressible, essentially functioning as a solid component. HLA may support a pivot 252 and a cooperating pedestal or foot 254, which may pivot or rotate relative to the pivot 252, thus providing for pivoting movement of the valve bridge 260, to some degree.

In this implementation, according to inventive aspects of the disclosure, the HLA is subject to the stroke-limited compressive force provided by a lash adjuster loading component in the form of the stroke limited piston 270 disposed in a bore 262 in the valve bridge 260. The stroke of the lash adjuster loading component is biased in a way that compresses the HLA, but is also limited by a stroke limiter 276 to prevent over compression of the HLA. A compression spring 272 is disposed in an internal bore 274 of the piston 270 and engages an end wall 275 thereof. An opposite end of compression spring 272 engages a bottom wall 263 of the valve bridge bore 262 and thus provides an upward force on the piston 270. A stroke limiter 276, which may be a snap ring or retaining ring fastened to the valve bridge 260, may engage and prevent upward travel of a shoulder 277 of the piston 270 and thus limits the upward movement of the piston 270 relative to the valve bridge 260.

Main event valve motion may be conveyed along a first load path from motion source (lost motion cam) 210 to the two engine valves 280, 282. More particularly, the first load path may be defined by the cam follower 222, rocker arm 220, the HLA 250 and the valve bridge 260. The first load path from the motion source to the engine valves may thus include valvetrain components of the cam follower 222, rocker arm 220, and HLA, including the pivot 252 and pedestal 254.

Auxiliary motion, such as braking motion, may be imparted to one of the engine valves 282, via a second load path, which includes the inboard valve actuator 240. An auxiliary motion bridge component, in this case in the form of bridge pin 266, may provide for the transfer of motion, separate from motion of the valve bridge 260, from the inboard valve actuator 240 to the braking valve 282. Inboard valve actuator 240 is a lost motion assembly or device, which may be selectively hydraulically activated and deactivated, via a switched hydraulic passage 227, at appropriate times during an engine cycle to effect auxiliary events, such as engine braking. Switched hydraulic passage 227 provides hydraulic fluid to piston bore 226, typically from an axially extending passage (not shown) in the rocker shaft which provides hydraulic fluid to a number of valve rockers mounted on the shaft. In an activated state, a piston 242 forming the inboard valve actuator 240 may be extended out of a corresponding piston bore 226 and maintained in an incompressible or solid extended state and thus transfer motion. In a deactivated state, the actuator piston 242 of the inboard valve actuator may be permitted to retract into its bore 226, thereby losing any transferred motion from the rocker arm and thus be in a compressible or motion absorbing state. As will be recognized, in this implementation, a second load path from the motion source to the braking valve 282 is defined by the auxiliary event motion valvetrain components (cam follower 222, rocker arm 220, inboard valve actuator 240) and by bridge pin 266.

As will be recognized, in accordance with inventive aspects of the disclosure, the above-described implementation provides separate load paths for the lash-adjusted main event valve actuation and the auxiliary event (braking) valve actuation. In operation, when engine braking is undertaken, inboard valve actuator 240 extends to impart motion to the inboard valve 282 only, it being recognized that rocker arm 220 will, at substantially the same time, have motion imparted by one of the auxiliary lobes on the lost motion cam. As the rocker goes from the inner base circle of the cam to the base circle defined by the auxiliary lobe, the rocker 220 will generate more stroke at the HLA, which is disposed at a further distance from the rocker arm pivot (center of the rocker arm shaft) than the inboard valve actuator. The lash adjuster loading component (stroke-limited bridge piston 270) will thus create a compressive load on the HLA and prevent any over-extension or jacking as the inboard side (right side in FIG. 2) of bridge 260 pivots downward in conjunction with the downward movement of bridge pin 266, which moves under force from the inboard valve actuator 240.

As shown in FIG. 2, a clearance exists between the bottom surface of the piston 270 and the bottom wall 263 of the valve bridge bore. This clearance defines a lost motion travel distance 279 for the piston lash adjuster loading component. The lost motion travel distance may be selected to ensure that the auxiliary event motions of the rocker arm 220 are "lost" and do not result in undesired motion of the valve bridge 260 and engine valves 280 and 282. That is, in a braking event, valve 282 will be actuated under motion from a braking lobe in the cam 210 transmitted via the inboard valve actuator, while the motion of the rocker arm 220 and HLA will be "lost" via the stroke limited piston 270 and not transmitted to the valve bridge or engine valve 280 until the piston 270 bottoms against bottom wall 263 of the valve bridge bore and results in motion of the valve bridge and opening of both valves for main event motion. The lost motion gap is designed to "lose" the motion that would otherwise result from the auxiliary event cam lift profiles, but without losing the main event motion.

Figure 4A:
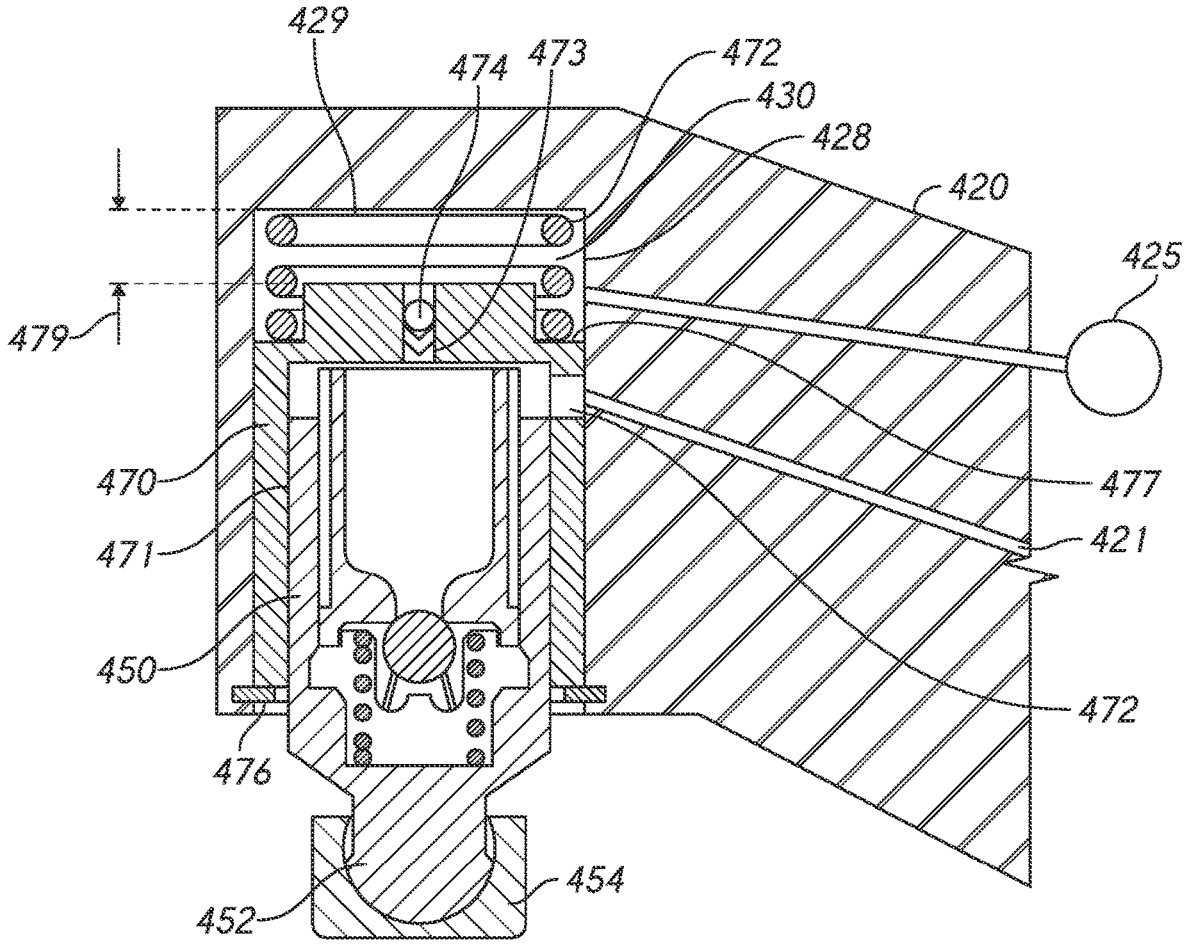
FIG. 4A is a cross-section showing details of another implementation of a lash adjuster and lash adjuster loading component in a modified configuration compared to that of FIGS. 1 and 2.

FIG. 4A illustrates an alternative arrangement for a lash adjuster loading component and HLA, according to aspects of the disclosure. In this implementation, features of the stroke limited piston are integrated into the rocker arm rather than the valve bridge (as in FIG. 2). This arrangement permits valve braking motion to be accomplished via the same load path in which the lash adjuster is disposed and thus may be used to eliminate the need for an independent valve actuator (inboard valve actuator) for facilitating valve braking motion. In this regard, the load path in which the lash adjuster is disposed (first load path) and the load path in which the auxiliary valve motion actuator is disposed (second load path) are the same. A rocker arm 420 may include a bore 428 for receiving a stroke limited piston 470, which in turn includes an HLA-receiving bore 471 for supporting an HLA therein. A travel limiter 476 limits travel (in a downward direction) of piston 470. A compression spring 472 is disposed in the rocker arm bore 428 and engages a shoulder 477 on the piston 470 on one end and a bottom bore wall 429 on another end, providing a compressive force on the HLA against the bridge (not shown) which is engaged by the pivot 452 and pedestal 454. As in the configuration illustrated in FIG. 2, the piston 470 is configured to define a chamber 430 with bore 428 and bottom wall 429 and to provide a lost motion travel distance 479 thereby preventing transmission of auxiliary valve events via the first load path. Piston 470 may include an annulus 472 which permits flow of hydraulic fluid from a constant (continuous) supply passage 421 in the rocker arm 420 to the HLA receiving bore 471 and the HLA. A switched fluid supply passage 424 may provide fluid to the bore 428 under control of a control valve 425. Fluid flow from the HLA may be prevented from bore 429 by tight clearances between the piston 470 and the bore 428. A vent 473 may be provided in the piston 470 and a check valve 474 provided therein to facilitate one-way flow to the HLA. In operation, when activation of the auxiliary motion valve is desired, the hydraulic fluid control valve 425 may be switched to provide hydraulic pressure (oil) to chamber 430 and extend the lash adjuster loading assembly (piston 470) and lock it in an extended position, thereby initiating valve braking motion. When the control valve 425 is switched off, the lash adjuster check valve indexes to an "off" position and chamber 430 can vent, by passage of fluid via vent 472 and check valve 474 to permit the brake to be deactivated. As will be recognized, this configuration permits braking motion to be undertaken via the same load path in which the lash adjuster is disposed. This may be used to eliminate the need for an independent (separate) valve actuator, such as an inboard valve actuator described above, to accomplish auxiliary valve motion.

Figure 4B:
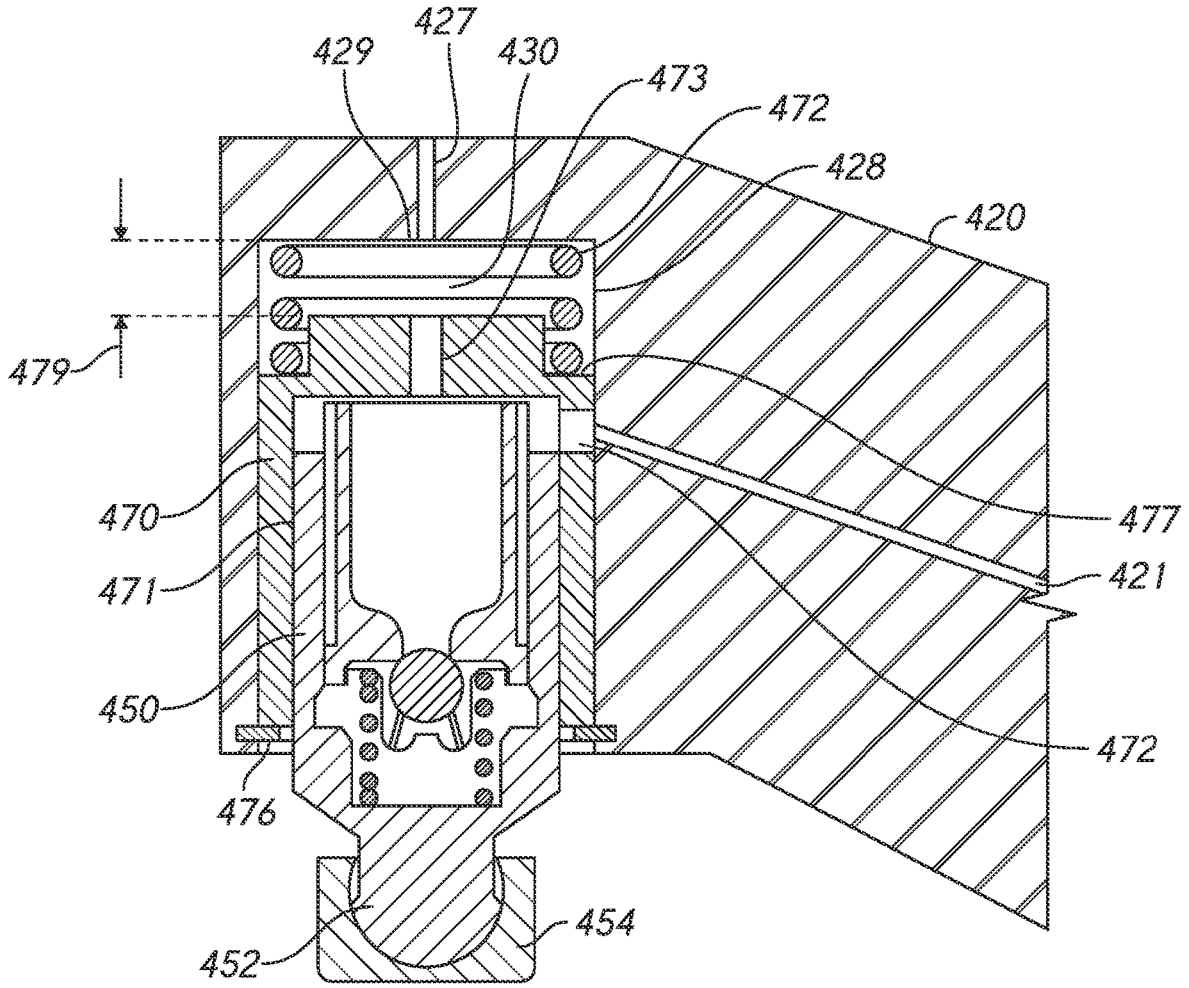
FIG. 4B is a cross-section showing details of yet another implementation of a lash adjuster and lash adjuster loading component in a modified configuration compared to FIG. 4A.

FIG. 4B illustrates an alternative arrangement for a lash adjuster loading component and HLA, according to aspects of the disclosure. In this implementation, features of the stroke limited piston are integrated into the rocker arm rather than the valve bridge (as in FIG. 2). This arrangement permits valve braking motion to be accomplished a second load path in which the lash adjuster is disposed and thus may be used in implementations utilizing an independent valve actuator (inboard valve actuator as described above) for facilitating valve braking motion. A rocker arm 420 may include a bore 428 for receiving a stroke limited piston 470, which in turn includes an HLA-receiving bore 471 for supporting an HLA therein. A travel limiter 476 limits travel (in a downward direction) of piston 470. A compression spring 472 is disposed in the rocker arm bore 428 and engages a shoulder 477 on the piston 470 on one end and a bottom bore wall 429 on another end, providing a compressive force on the HLA against the bridge (not shown) which is engaged by the pivot 452 and pedestal 454. As in the configuration illustrated in FIG. 2, the piston 470 is configured to define a chamber 430 with bore 428 and bottom wall 429 and to provide a lost motion travel distance 479 thereby preventing transmission of auxiliary valve events via the first load path. Piston 470 may include an annulus 472 which permits flow of hydraulic fluid from a constant (continuous) supply passage 421 in the rocker arm 420 to the HLA receiving bore 471 and the HLA. Fluid flow from the HLA may be prevented from bore 429 by tight clearances between the piston 470 and the bore 428. In operation, hydraulic fluid is supplied to the lash adjuster via continuous supply passage 421 and annulus 472. Chamber 430 may be without any hydraulic fluid, i.e., occupied by air. A vent 427 may vent air to the outside environment. Air from the lash adjuster may vent to chamber 430 via vent 473. As will be recognized, this configuration may be utilized in engine environments eliminate where an independent (separate) valve actuator, such as an inboard valve actuator described above, is utilized to accomplish auxiliary valve motion.

As will be recognized by those of ordinary skill in the art, the embodiments described above with regard to FIGS. 2 and 4B may be used in environments where auxiliary motion is applied to at least one valve, with an auxiliary motion source that is separate from the main event motion source. For example, in auxiliary motion systems where auxiliary motion is facilitated by a dedicated rocker arm or bolt-on master slave brake, or any auxiliary motion source that is not necessarily a lost motion main event motion source. The motion of the main event rocker arm may be timed with the auxiliary motion events such that the compression spring (274 in FIG. 2, or 472 in FIG. 4B, for example) remains at least partially compressed during these events, but not fully compressed to the point where lift is provided in positive power or during auxiliary lift events. This prevents extension of the lash adjuster during any auxiliary motion events by preloading the lash adjuster with the main event motion.

Figure 5:
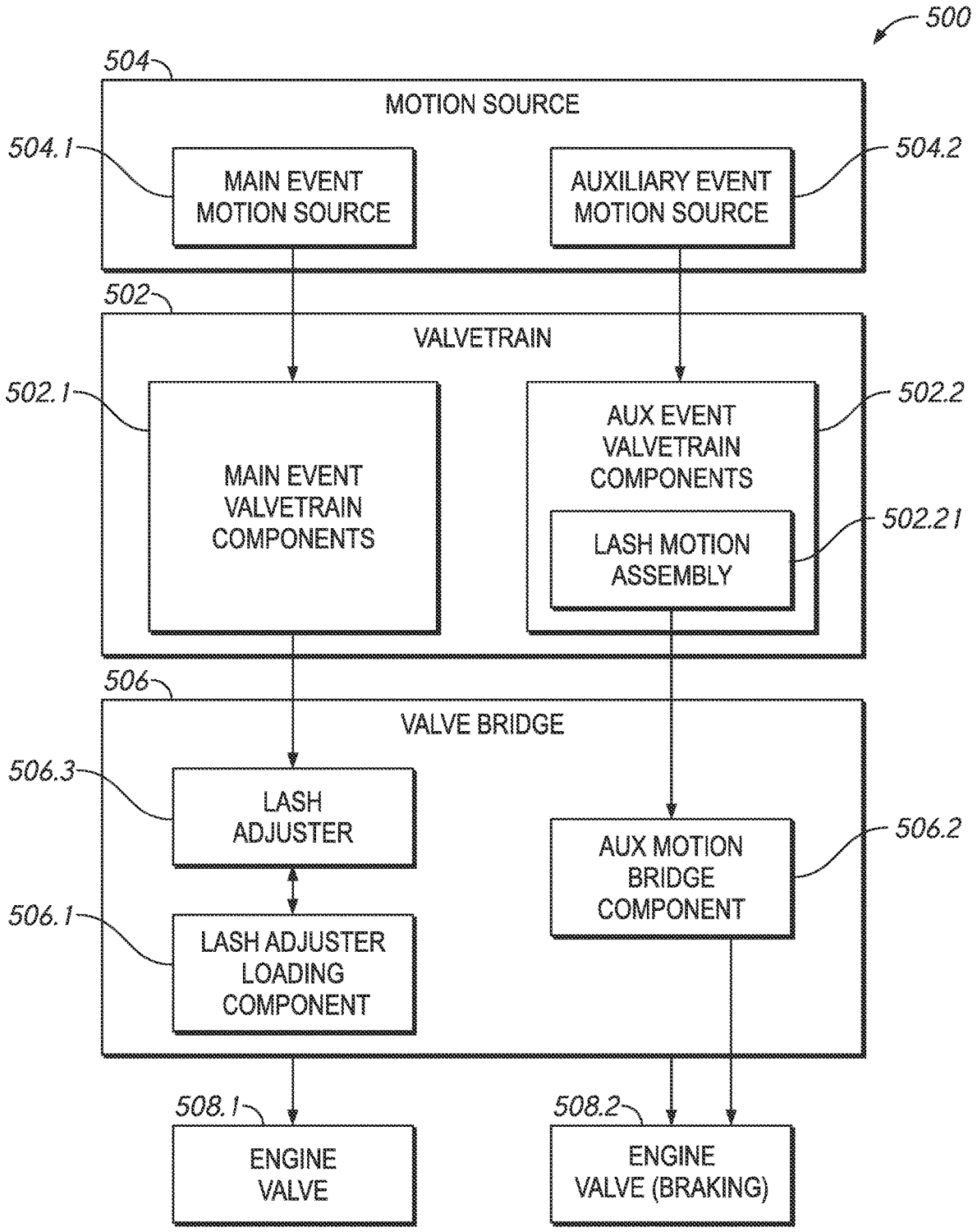
FIG. 5 is a schematic block diagram of a valve actuation system in accordance with further aspects of the disclosure.

FIG. 5 is a schematic block diagram of a valve actuation system 500 according to further aspects of the disclosure. This system is similar to the system described above with regard to FIG. 1. However, some differences relate to the location of the lash adjuster. More specifically, the lash adjuster 506.3 may disposed in the valve bridge 506 along with the lash adjuster loading component 506.1. Valve actuation motion source 504 may include main event motion source components 504.1 and auxiliary event motion source components 504.2. Motion from the motion sources 504.1 and 504.2 is transferred to valvetrain 502, which may comprise main event motion valvetrain components 502.1 and auxiliary event motion valvetrain components 502.2. These component sets may include common elements, such as a single rocker arm. A lost motion assembly 502.21 may be included in the auxiliary event motion valvetrain components 502.2, in which case the component can function as a housing for the lost motion assembly.

The valvetrain components transmit motion to the valve bridge 506, and/or components thereof. A lash adjuster 506.3 and lash adjuster loading component 506.1 may be disposed in the valve bridge 506. An auxiliary motion bridge component 506.2 may be provided as a component to the valve bridge 506 and may include, for example, a bridge pin, which permits transfer of motion from the lost motion assembly 502.21 to a braking engine valve 508.2 without imparting motion to the valve bridge 506. According to an aspect of the disclosure, a lash adjuster loading component 506.1 functions to keep the lash adjuster 506.3 in a loaded state (i.e., with a force against the extended direction of the lash adjuster).

Figure 6:
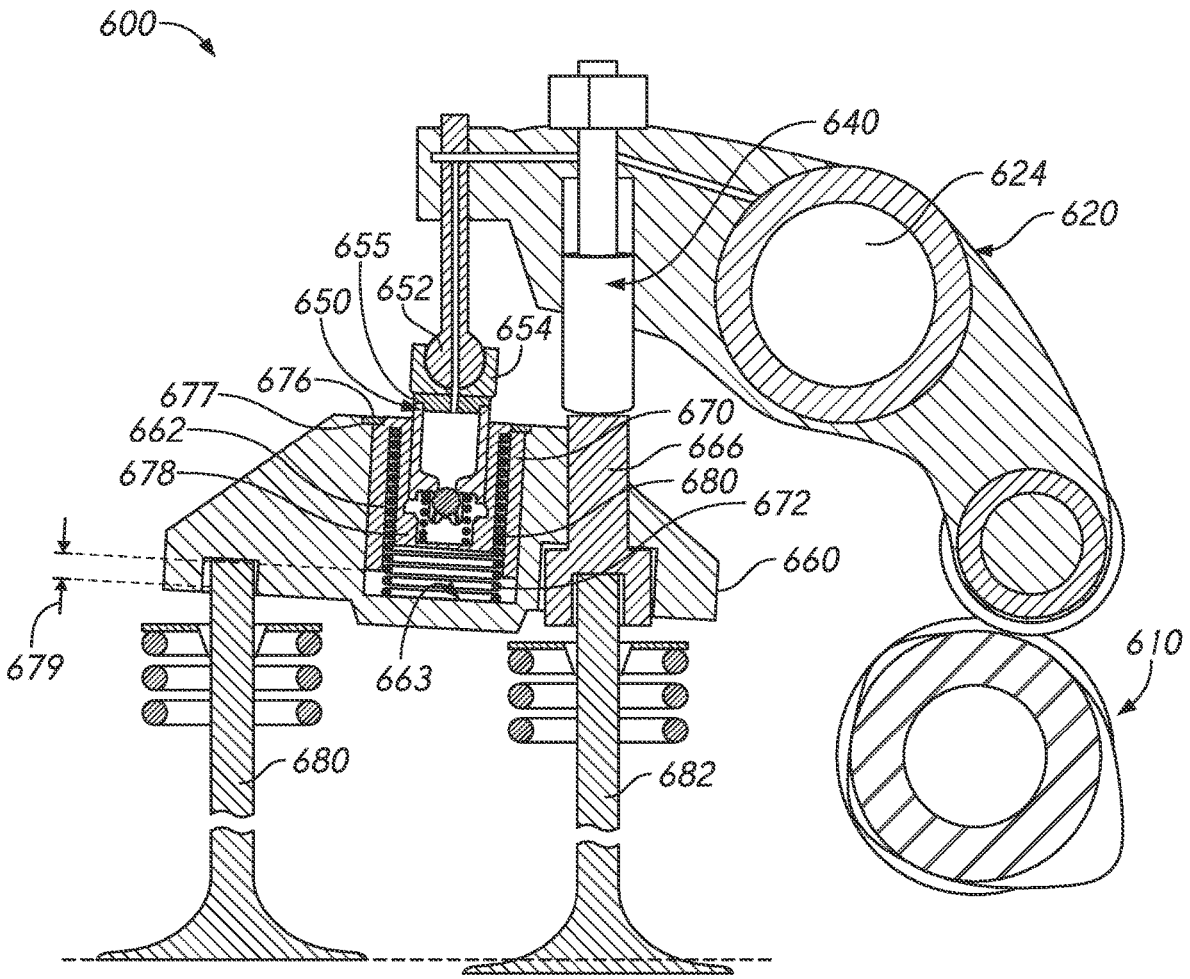
FIG. 6 is a schematic example implementation of a valve actuation system in accordance with the instant disclosure and the system of FIG. 5.

FIG. 6 is a schematic illustration of a valve actuation system 600 in an implementation which is consistent with the functional block diagram of FIG. 5. Rocker arm 620 is driven by lost motion cam 610 and includes an inboard valve actuator 640, which cooperates with a bridge pin 666 to impart motion to a braking valve 682. Rocker arm 620 also includes a static (solid) extended pivot 652 extending from and end thereof and having a swivel or ball. Pivot 652 cooperates with an e-foot pedestal 654 which engages an HLA base 655 to impart motion to an HLA/bridge assembly, as further described. A hydraulic fluid passage 622 may extend through the pivot 652, the pedestal 654 and the rocker arm from the journal to hydraulically actuated components such as the inboard valve actuator 640 and HLA 650.

A stroke-limited piston 670 is mounted within a bore 662 in the valve bridge 660. A shoulder 677 may be provided on an upper surface of the piston for engaging a travel limiter 676 fastened to the bridge 660. Piston 670 also includes an inner annular wall 678 configured for housing the components of the HLA. Annular wall 678 also defines an annular recess 680 which partially houses a compression spring 672 to bias the piston in an upward direction. Compression spring 672 engages a bottom wall 663 of the bridge bore 662 and an upper wall defined within the annular recess 680 of the piston 670. A lost motion gap having a clearance 679 is defined between the bottom end of the piston 670 and the bridge bore bottom wall 663.

In operation, during main event (positive power) motion of the engine, the rocker arm 620 imparts main event motion from the lost motion cam 610 to the valve bridge via pivot 652, pedestal 654 and the HLA 650. The constant compressive forces provided on the bridge-located lash adjuster loading component, which includes the spring piston 670 and related components, operates to ensure that over-extension or "jacking" of the HLA 650 does not occur. During auxiliary motion, when a braking operation is being performed or is active, the motion from the rocker arm 620 is transmitted through the activated inboard valve actuator 640 to the bridge pin 666 and braking valve 682. The motion of the rocker arm, owing to the rocker ratio and respective locations of the inboard actuator and the fulcrum 652 on the rocker arm 620, will result in a larger displacement or stroke of the HLA than the stroke undertaken by the inboard valve actuator. This larger stroke will result in a compressive force from the stroke-limited piston 670 acting against the HLA to thereby prevent overextension. The lost motion function of the HLA mounting configuration, owing to the clearance 679 between the piston 670 and the bridge bore bottom wall 663 will operate to "hide" the auxiliary motion of the rocker arm from the valve bridge 660, and thus the engine valves 680 and 682, it being understood that valve 682 will still undergo movement according to the braking action.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. An apparatus for actuating at least one of two or more engine valves in an internal combustion engine, comprising:

a valve bridge operatively associated with the two or more engine valves;

a rocker arm for transmitting motion from a motion source to the valve bridge through a first load path;

a valve actuator for transmitting motion from the motion source to one of the two or more engine valves through a second load path;

a lash adjuster disposed in the first load path;

a lash adjuster loading assembly disposed in the first load path and adapted to prevent overextension of the lash adjuster when the valve actuator transmits motion to the one engine valve.

2. The apparatus of claim 1, wherein the lash adjuster is g hydraulic lash adjuster disposed in the rocker arm.

3. The apparatus of claim 2, wherein the lash adjuster loading assembly comprises a piston located in the valve bridge and is biased in a direction that compresses the lash adjuster.

4. The apparatus of claim 1 wherein the lash adjuster loading assembly comprises a piston, a biasing element for biasing the piston in a direction that compresses the lash adjuster, and a stroke-limiter for limiting the stroke of the piston.

5. The apparatus of claim 2, wherein the lash adjuster loading assembly comprises a piston disposed on a bore in the rocker arm and a biasing element for biasing the piston in a direction that compresses the lash adjuster.

6. The apparatus of claim 1, wherein the lash adjuster is disposed within a bore in the valve bridge.

7. The apparatus of claim 6, wherein the lash adjuster loading assembly comprises a piston disposed the bore in the valve bridge for biasing the piston in direction that compresses the lash adjuster.

8. The apparatus of claim 1, wherein the motion source is a lost-motion cam lobe having a main event portion of the cam lobe and an auxiliary event portion of the same cam lobe.

9. The apparatus of claim 8, where the main event portion of the cam lobe represents a primary motion source and the secondary portion of the same cam lobe represents an aux motion source.

10. The apparatus of claim 1, wherein the valve actuator is a lost motion device.

11. The apparatus of claim 10, further comprising a rocker shaft for the rocker arm, wherein the valve actuator is located closer to the rocker shaft than the lash adjuster.

12. The apparatus of claim 1, wherein the lash adjuster is housed in the rocker arm.

13. The apparatus of claim 12, wherein the lash adjuster loading assembly is housed in the valve bridge.

14. The apparatus of claim 1, wherein the lash adjuster is housed in the valve bridge.

15. The apparatus of claim 14, wherein the lash adjuster loading assembly is housed in the valve bridge.

16. The apparatus of claim 1, wherein the lash adjuster loading assembly is a lost motion device.

17. The apparatus of claim 1, wherein the lash adjuster loading assembly includes a stroke-limited piston.

18. The apparatus of claim 1, wherein the first load path and second load path are coextensive, the lash adjuster and valve actuator being disposed in the same load path.

19. An apparatus for actuating at least one of two or more engine valves in an internal combustion engine, comprising:

a rocker arm operatively associated with one or more engine valves and configured for transmitting motion from a motion source to one or more engine valves;

a lash adjuster disposed in the rocker arm;

a lash adjuster loading assembly disposed in the rocker arm and configured to apply compressive load to the lash adjuster, wherein the lash adjuster loading assembly is adapted to permit lost motion;

and wherein the lash adjuster loading assembly may be selectively locked in an extended state to activate an auxiliary lift profile on the motion source.

20. An apparatus for actuating at least one of two or more engine valves in an internal combustion engine, comprising:

a valve bridge operatively associated with the two or more engine valves;

a rocker arm for transmitting motion from a motion source to the valve bridge through a first load path;

a valve actuator for transmitting motion from the motion source to one of the two or more engine valves through a second load path;

a lash adjuster disposed in the first load path, the lash adjuster being adapted to automatically extend to take up lash in the first load path; and a lash adjuster loading assembly disposed in the first load path for applying a load to the lash adjuster to prevent overextension thereof.

* * * * *